US009821217B2

(12) United States Patent
Krishnamurty et al.

(10) Patent No.: US 9,821,217 B2
(45) **Date of Patent: *Nov. 21, 2017**

(54) INTELLIGENT TABLE GAME SYSTEM

(71) Applicant: The United States Playing Card Company, Erlanger, KY (US)

(72) Inventors: Venkata Krishnamurty, Sheboygan, WI (US); Dylan Horvath, Toronto (CA); Scott Bodaly, Toronto (CA)

(73) Assignee: The United States Playing Card Company, Erlanger, KY (US)

( * ) Notice: Subject to any disclaimer, the term of this patent is extended or adjusted under 35 U.S.C. 154(b) by 118 days.

This patent is subject to a terminal disclaimer.

(21) Appl. No.: 14/187,895

(22) Filed: Feb. 24, 2014

(65) Prior Publication Data

US 2014/0171170 A1 Jun. 19, 2014

Related U.S. Application Data

(63) Continuation of application No. 13/152,417, filed on Jun. 3, 2011, now Pat. No. 8,657,287.

(51) Int. Cl.

| | |
|---|---|
| ***A63F 1/14*** | (2006.01) |
| ***A63F 1/12*** | (2006.01) |
| ***A63F 1/18*** | (2006.01) |

(52) U.S. Cl.
CPC . *A63F 1/14* (2013.01); *A63F 1/18* (2013.01)

(58) Field of Classification Search
CPC ..... A63F 1/06; A63F 1/08; A63F 1/10; A63F 1/12; A63F 1/14
USPC ..... 273/149 R
See application file for complete search history.

(56) References Cited

U.S. PATENT DOCUMENTS

| | | | | |
|---|---|---|---|---|
| 4,798,958 | A * | 1/1989 | Janesick et al. | 250/370.01 |
| 6,582,301 | B2 | 6/2003 | Hill | |
| 8,210,536 | B2 | 7/2012 | Blaha et al. | |
| 2008/0143048 | A1 * | 6/2008 | Shigeta | 273/149 R |

* cited by examiner

*Primary Examiner* — Kevin Y Kim
(74) *Attorney, Agent, or Firm* — Seth Blum

(57) ABSTRACT

A card dealing system incorporating playing cards with rank and suit information encoded thereon via micro-dots, and a shoe capable of reading such micro dots as a playing card is drawn from the shoe. A game controller unit determines the location of the micro-dots on the playing card, and determines the rank and suit information therefrom. The game controller thereby monitors the progress and status of a card game.

9 Claims, 12 Drawing Sheets

310 330 320 300

| | SPADES | CLUBS | HEARTS | DIAMONDS |
|---|---|---|---|---|
| A | 1,1 | 2,7 | 4,6 | 6,5 |
| 2 | 1,2 | 3,1 | 4,7 | 6,6 |
| 3 | 1,3 | 3,2 | 5,1 | 6,7 |
| 4 | 1,4 | 3,3 | 5,2 | 7,1 |
| 5 | 1,5 | 3,4 | 5,3 | 7,2 |
| 6 | 1,6 | 3,5 | 5,4 | 7,3 |
| 7 | 1,7 | 3,6 | 5,5 | 7,4 |
| 8 | 2,1 | 3,7 | 5,6 | 7,5 |
| 9 | 2,2 | 4,1 | 5,7 | 7,6 |
| 10 | 2,3 | 4,2 | 6,1 | 7,7 |
| J | 2,4 | 4,3 | 6,2 | 8,1 |
| Q | 2,5 | 4,4 | 6,3 | 8,2 |
| K | 2,6 | 4,5 | 6,4 | 8,3 |

INTELLIGENT TABLE GAME SYSTEM

The present application is a Continuation of U.S. application Ser. No. 13/152,417 entitled Intelligent Table Game System, filed on Jun. 3, 2011, the contents of which are herein incorporated by reference in its entirety.

BACKGROUND OF THE INVENTION

The present invention relates to an intelligent table game system. More specifically, the present invention relates to a card dealing system incorporating playing cards with rank and suit information encoded thereon via micro-dots, and a shoe capable of reading such micro dots as a playing card is drawn from the shoe.

Card games in a casino are profitable, but are also prone to cheating and fraud by players, dealers and the pit crew. The fraudulent activity is therefore a significant source of the revenue losses at a casino. In order to prevent and/or mitigate these losses, casinos continue to identify and implement security features and enhancements. One such security device is a smart shoe that is capable of reading and tracking the rank and suit of playing cards which are drawn from the shoe. Such shoes may be capable of reading the rank characters and suit symbols directly from a standard playing card, or may read specialized data encoded on the playing card in some fashion.

1) Playing Cards

Playing cards may be encoded with encrypted information that is machine readable. Normally, such information is invisible to the naked eye so as not to interfere with the standard aesthetics or functionality of the card, and so as not to be easily discerned by players. The encryption typically contains information regarding the rank and suit of the card, or other information. These coded playing cards serve an important role in enhancing the security at card games in casinos. With encoded playing cards, smart game devices such as electronic shoes can decode the encryption and identify the card value (rank and suit). This prevents players or dealers from introducing fraudulent playing cards into the game which might provide the player or dealer with an unfair advantage.

Current encryption techniques use bar codes on the edges of cards or ultra violet ("UV") reaction codes that are invisible to the naked eye. Bar codes are good encryption methods but compromise the aesthetics of the playing card. The UV reaction code based encryption techniques while addressing the customer need for enhanced security—are deficient and pose many process challenges. First, the codes are invisible and difficult to monitor in a production process, thus potentially compromising quality. Second, due to variability in the production (punching/cutting) of playing cards, there are occasions where the cut passes through the UV codes, thereby compromising the machine readability of the cards. To ensure machine readability of UV codes, the tolerances required on cut registration are restrictive and thereby generate a significant quantity of unusable or defective cards. Third, printing UV codes requires an extra step in the process, i.e., a separate printing plate with the UV codes has to be introduced into the process and an additional step is added in printing the codes with UV ink. This step is a significant cost addition to the printing of playing cards. Fourth, UV ink is highly sensitive to environmental conditions and ambient lighting. Temperature, humidity and fluorescent lighting degrade the intensity of the UV ink and thereby affect the reliability of machine readability of the encoded data. Fifth, the invisibility of UV inks aggravates the problem of smudging and could drastically affect the quality of the cards and their readability.

Thus, a better system of encoded information on playing cards invisibly to players is needed.

2) User Interface

Game tables at casinos currently use electronic shoes that read and decode card values from the coding on the cards. These electronic shoes have the necessary firmware programmed to decode, decide game outcomes, setup the equipment for game play and to diagnose problems with functionality or to reset alarms (used to alert the user/supervisor to improper use of the equipment). The firmware also provides security in terms of password protection to prevent tampering or improper use. The interface for the user with this firmware is through the use of a small LCD screen embedded on the side of the electronic shoe and associated buttons typically located on the back of the shoe.

3) Version Control

Current design of electronic shoes used at casinos requires a service technician to connect a laptop (computer) to the shoe in order to upgrade the shoe to a new/improved version of the firmware. This is a cumbersome, time consuming, manual process that also adds cost to the manufacturer via increased labor, and to the casino via downtime during upgrades. This can be quite costly, as casinos in Macau, for example, typically operate at an 85-90% occupancy rate at the tables. The downtime during the version upgrade could be very expensive to a casino given the large amounts of money wagered at these tables.

4) Language

English is the national language in the United States. However, casinos in Macau have surpassed Las Vegas as the most popular gaming locales in the world. Increasingly, casinos in South Korea and other East Asian countries as well as casinos in Latin America are becoming more attractive to gamblers. The electronic shoes used in these casinos currently require a working knowledge of English for the user to operate the equipment.

5) Electrical Power

Card game tables (such as those used in the playing of Baccarat or Blackjack, etc.) at casinos are very constrained environments. There are very few power outlets available to plug in all the necessary electronic equipment at the game table. An electronic shoe requires the need for an additional supply outlet to power the equipment. This would also require the use of a power surge protector to allow for safe and effective use of the equipment during power shutdowns. Supplying power therefore currently poses certain challenges. The layout of game tables can be compromised to ensure proximity to power supply and power surge protectors, and electronic equipment must be designed to accommodate variations in power supply, globally (e.g., 110V, 50 Hz in the US; 220V, 60 Hz in Macau, etc.).

6) Fault Tolerance (Card Gate) & Dealer Alert

Baccarat is purely a game of chance. The game is decided based on the cards dealt. Occasionally, the dealer of the game might mistakenly deal an extra card even after the game outcome has been decided by the cards dealt prior. In the design of current electronic shoes, an alarm would be sounded to alert the dealer that an extra card (card overdraw) had been dealt. The pit supervisor, at this point, would have to get to the game table and resolve the alarm and ensure that the game at the table resumes. Additionally, in one variation of the game of Baccarat called Commission Baccarat, when the banker wins, the dealer will collect a prescribed percentage of the wager as commission from the players who bet on the banker to win. There are occasions when the dealer of the game might not collect these commissions, as a result of oversight.

BRIEF SUMMARY OF THE INVENTION

The present invention described herein presents a self contained, integrated system that monitors the cards being used during the playing of the game. The devices form an intelligent table game system which offers a strong security to the game while enhancing the card dealer's experience at the table without affecting the entertainment to the players. The invention described herein also includes a new encryption method for playing cards which can be used to represent card rank and suit information.

1) Encryption:

The present invention described herein uses micron dots or "micro-dots" which are measured on a scale of microns (0.000001 meters)—on the face of the playing card. Testing and surveys have identified that the size of the micro-dots can be between 20 microns and 200 microns in diameter (or in the case of a square—in length of a side) before they become visible to the naked eye. Thus, the micro-dots are preferably between 20 and 200 microns in diameter, though it is recognized that smaller dots may be used so long as reading the micro-dots is still possible. Similarly, larger dots may be used but may become conspicuous.

The description below includes an encryption methodology to encode the rank and suit of a playing card on the face of the playing card via micro-dots, thereby allowing an intelligent card dealing device to read and decode the encrypted rank and suit data as a card is drawn. The intelligent card dealing device is then capable of displaying the card information onto a game display board. In a preferred embodiment, the location of the dot in a uniform grid is used as an encryption and such location determines the rank and suit of the playing card. However, this encoding technique—as will be described below—is merely exemplary, and it will be recognized that the possible encoding methods are unlimited. It will also be recognized that additional information besides rank and suit, such as the manufacturer, brand name, casino name, the table at which the game is played, the manufacture date and location, etc., can be encoded on a playing card via micro-dots.

In a preferred embodiment, the assignment of micro-dot locations to the various cards may be determined using a random number generation. The random generation of the micro-dot locations allows for the possibility of designing unique codes so as to provide an extra level of security to the casino operators, though any system of assigning dot locations to specific card information could be used. An added level of redundancy may be applied by printing the dots at two locations on the face of the card, i.e., the corner opposite the location of the rank and suit displayed on the cards and the middle of the card face.

In one embodiment, a camera is provided for imaging the region of the playing card on which the dots are printed. An LED light source may be constantly illuminated when the shoe is powered on, though first and second card sensors (described below) can be used to trigger the LED light source to strobe, so as to illuminate the card face only when needed.

The imaging system may utilize mirrors to provide a periscoping effect in capturing the image. However, designs without mirrors are also feasible. Where such mirrors are used, (1) the angle of the mirror, (2) the optical path and (3) its apparent distortion of the micro-dot image should be considered when calculating the locations of and distances between the dots.

In one embodiment, 9 pixels (3×3) are sufficient to locate the micro-dots precisely with a camera having an image resolution of 640×480 pixels. With such a camera, an area of approximately 21×16 mm will be scanned. A series of decision criteria and/or filtering algorithms are used to isolate the micro-dots in the image. This filtering algorithm also helps to remove spurious objects in the image or region of interest. In playing cards, these spurious objects could be due to any or all of "scumming" (the splattering of ink during printing), card dust, or embedded fibers from the paper pulp.

The micro-dots are preferably located in the scan using a binary large object detection ("BLOB") analysis. BLOB analysis generally attempts to detect points in an image that are darker than the surrounding. The factors used to isolate or identify the dots include: (1) a histogram of the pixel intensities in the image (used to remove the background); (2) the number of pixels in each object; (3) an aspect ratio of the objects between about 0.8 and 1.0, i.e., generally radially uniform (where aspect ratio=pixels in y dimension/pixels in x dimension); and (4) the location of binary objects within region of interest (with reference to expectations based on card registration and manufacturing tolerances). Generally, the largest four objects are selected, though it is recognized that where even smaller micro-dots are used, the dots may be smaller than surrounding imperfections.

Once the micro-dots are located in the image, the distance between the dots is measured in both the x and y directions. The distances are then used to decode the grid location of the dots.

2) Smart Peripherals—a Closed Loop Card Game System at the Table

The smart peripherals at the game table include an electronic shoe, a game controller unit and a discard rack. The card shoe is similar in form and fit to current electronic shoes, but the shoe is significantly different in terms of its components and its functionality. The nose of the shoe is equipped with a camera, mirrors and LED lighting to capture an image of the portion of the card that contains the micro-dot code. The shoe also has two sensors and a mechanical card gate in the nose of the shoe.

The actuation of the mechanical card gate is accomplished using an electro-magnet (which helps open the gate) and a spring loaded system (which helps close the gate). Open gate implies that the card gate is down and cards can be pulled out of the shoe. Closed gate implies that the card gate is up and will prevent cards from being pulled out. The normal play of the game is identical to and based on the established rules of baccarat.

3) User Interface

The ability for a dealer to interact with the electronic shoe is not ergonomic or comfortable in prior art systems. Generally, interacting with such prior art shoes is done through the use of buttons at the back of the shoe and a small monochromatic LCD screen on the side of the shoe. This interface is not user friendly, especially given the long work hours and the environment at most casino tables. The present invention uses a convenient and user friendly touch screen (as part of the game controller unit) for interface with the equipment.

In one embodiment described herein, the touch screen is approximately 5"×3" which provides a large screen for viewing the graphical user interface (GUI) menu and the game outcomes. The interaction with the firmware/software is through a touch-sensitive screen (which can be a resistive touch screen or a capacitive touch screen). The GUI display is also preferably in color and can be customized for the casino and personalized for the user.

4) Version Control

In the present invention, necessary updates and upgrades to the firmware or software are accomplished through, for example, the use of a portable electronic storage device. The manufacturer of the equipment ships such a storage device to the casino with the necessary upgrades. The casino or equipment administrator plugs the storage device into the game controller, and upon user authentication for security purposes, the necessary upgrades are automatically loaded into the equipment. This provides efficiencies in servicing the equipment with no or minimal down times and reduced labor costs to both the manufacturer and the customer.

5) Multi-Lingual

The graphical user interface (GUI) is configured or programmed such that the user can interact with the device in a language that is familiar to them. Programming to allow the system to display in any desired language may be provided.

6) Fault Tolerance

The dealing of cards in playing games at casino tables is mostly manual and therefore susceptible to errors. The present invention includes a mechanical card gate to minimize or eliminate some of these possible errors. The game controller controls the functionality of the card gate based on the game progress and the identification of the card values that are drawn from the shoe. Chiefly, the card gate prevents cards from being inadvertently pulled out of the shoe even after the game outcome is decided. Card overdraw, as this is called, is a common mistake at game tables and can unnecessarily disrupt the progress of the game at the table. The game controller also reminds the dealer to collect commissions when the game played at the table is Commission Baccarat.

7) Power-Over-Ethernet

The game controller has an integral Ethernet port and an input for regulated power supply. As is common with most electronic devices, power can be supplied to the game controller and the electronic shoe through either the Ethernet connection or through the regulated power supply. A switch allows the user to conveniently switch powering the device through regular power supply or by an Ethernet power supply provider.

It should be understood that the present drawings are not necessarily to scale and that the embodiments disclosed herein are sometimes illustrated by graphic symbols, phantom lines, diagrammatic representations and fragmentary views. In certain instances, details which are not necessary for an understanding of the present invention or which render other details difficult to perceive may have been omitted. It should be understood, of course, that the present invention is not necessarily limited to the particular embodiments illustrated herein. Like numbers utilized throughout the various Figures designate like or similar parts or structure.

DETAILED DESCRIPTION OF THE INVENTION

Figure 1:
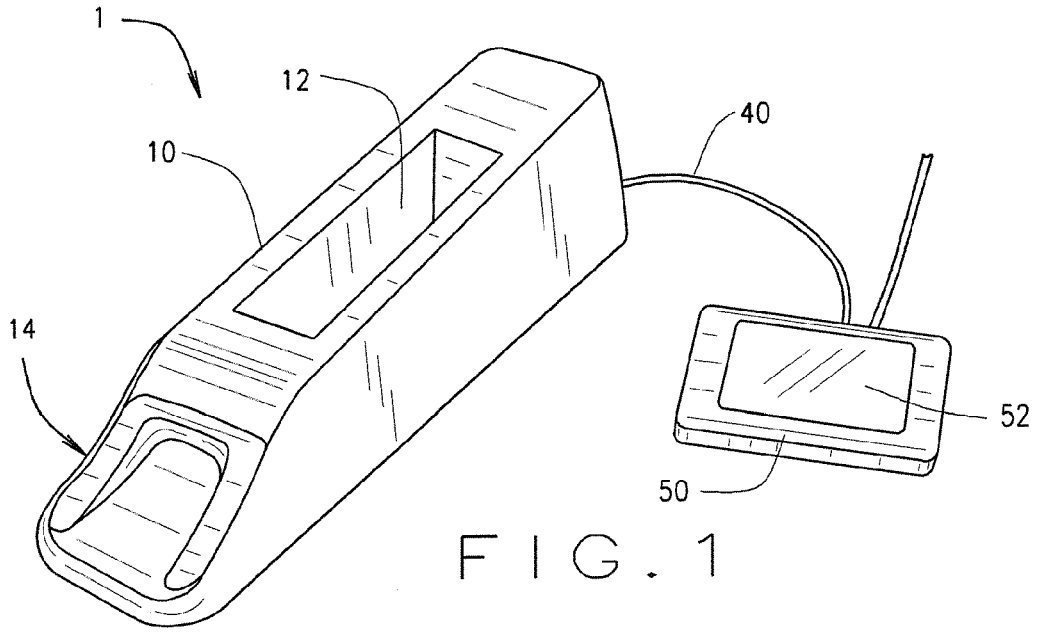
FIG. 1 is a perspective view of an improved shoe as connected to a game controller unit constructed in accordance with the teachings of the present invention.

As can be seen in FIG. 1, the invention described herein presents a self contained, integrated system that monitors the cards being used during the playing of the game.

The devices form an intelligent table game system 1 which offers a strong security to the game while enhancing the card dealer's experience at the table without affecting the entertainment to the players. The intelligent table game system 1 includes a shoe 10 having a card cradle 12 and a card removal portion 14. A lockable cover is removeably positionable over the card cradle 12, preventing unauthorized access to the cards. The shoe 10 is connected to and in electrical communication with a game controller unit 50 via a cable 40. The game controller unit 50 may include a display 52. The cable may be a standard Ethernet cable, a USB cable, or any other cabling sufficient to allow communication between the shoe 10 and the game controller unit 50. The cable 40 allows the game controller unit 50 to be in data communication with the shoe 10 such that electronic information can be passed between the shoe 10 and game controller unit 50 via cable 40. The game controller unit 50 may also be incorporated into the shoe 10.

Figure 2A:
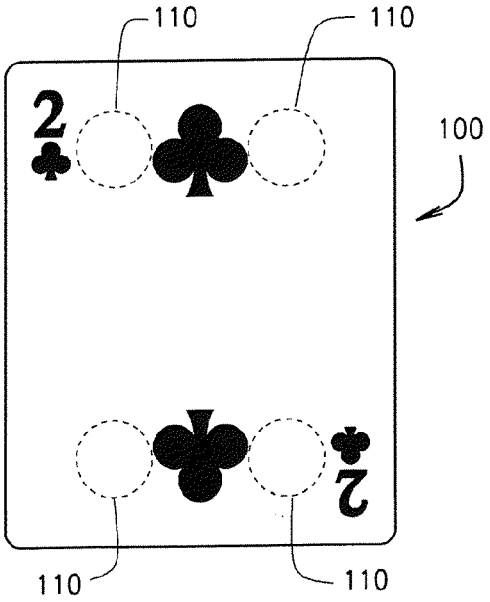
FIG. 2A is an exemplary playing card having at least one region in which micro-dots are printed.

The shoe 10 holds playing cards 100, an example of which is shown in FIG. 2A. The invention described herein also includes a new encryption method for playing cards 100 which can be used to represent card rank and suit information. Preferably, each playing card 100 in a deck would include at least one, and more preferably, at least two regions of interest 110 on the face of the playing card 100. The playing card 100 in FIG. 2A includes four regions of interest 110. The invention described herein uses nearly micron-sized dots or "micro-dots" 120 which are measured on a scale of microns (0.000001 meters)—on the face of the playing card 100. Testing and surveys have identified that the size of the micro-dots 120 can be between 20 microns and 200 microns in diameter before they become visible to the naked eye. Thus, the micro-dots 120 are preferably less than 200 microns in diameter, and more preferably between 20 and 200 microns in diameter. However, it is recognized that the smaller a micro-dot 120 becomes, the more difficult it may be to locate in a region of interest 110, and the more difficult it may be to differentiate from a mere flaw. Similarly, larger micro-dots 120 may be used, but may become conspicuous.

The Playing Cards and Micro-Dots

Figure 2B:
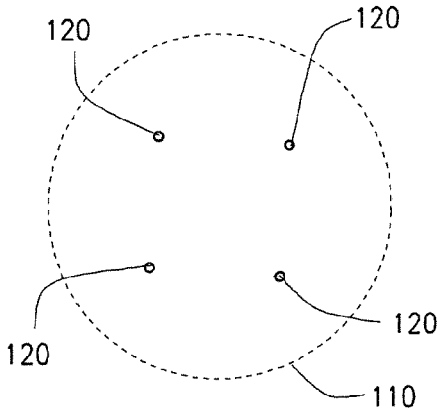
FIG. 2B is a view of a region of FIG. 2A, as zoomed in such that the micro-dots are visible.

FIG. 2B illustrates an exemplary region of interest 110, in which micro-dots 120 are visible. It is noted that FIG. 2B is not to scale, as the perspective is greatly zoomed in to expand the region of interest 110, and the micro-dots 120 have also been enlarged to make them visible to the naked human eye. Preferably, the micro-dots 120 are printed so as not to be visible to the naked human eye, i.e., a person with 20/20 vision who is unaided by anything capable of magnifying an image. In one embodiment, the dots are printed in a yellow color so as to help make them invisible to the naked eye. Yellow is a color which is often more difficult for the human eye to perceive. While yellow is the preferred color for the dots, the invention is not limited to this color.

As mentioned above, the present invention utilizes an encryption methodology to encode the rank and suit of a playing card 100 on the face of the playing card 100 via micro-dots 120, thereby allowing an intelligent card dealing shoe 10 to read and decode the encrypted rank and suit data as a card 100 is drawn from the shoe 10. The intelligent card dealing shoe 10 is then capable of displaying the card 100 information onto a display 52. In a preferred embodiment, the location of the micro-dots 120 in a uniform grid is used as an encryption and determines the rank and suit of the playing card 100. However, this encoding technique is merely exemplary, and it will be recognized that possible encoding methods are unlimited when using micro-dots 120. It will also be recognized that additional information besides rank and suit, such as the manufacturer, brand name, casino name, the table at which the game is played, the manufacture date and location, and other such information, can be encoded on a playing card 100 via micro-dots 120.

In a preferred embodiment, the encryption method uses an 8×7 grid to locate the micro-dots. However, other grid dimensions may be equally effective. An 8×7 grid, with 56 possible grid locations, was identified to be the most compact design for the distribution of dots that represent the fifty two cards that make up a deck of playing cards. Each card is assigned at least one unique location on the 8×7 grid. The assignment of the dots to the various locations on the 8×7 grid may be determined using a random number generation. The random generation of the grid locations for the micro-dots allows for the possibility of designing unique codes so as to provide an extra level of security to the casino operators, though any system of assigning dot locations to specific card information could be used.

For the purposes of explaining the details of the encryption, a micro-dot size of 20 pixels will be used. However, the technique is not limited to this size or the spacing between the dots. An example assignment of the dots is presented in the exemplary lookup table 300 in FIG. 3. Column 310 lists the possible ranks, while row 320 lists the possible suits. Each cell of the table includes a unique x-y coordinate 330. For example, in FIG. 3, the Five of Hearts is assigned coordinate (5, 3).

Figures 3, 4:
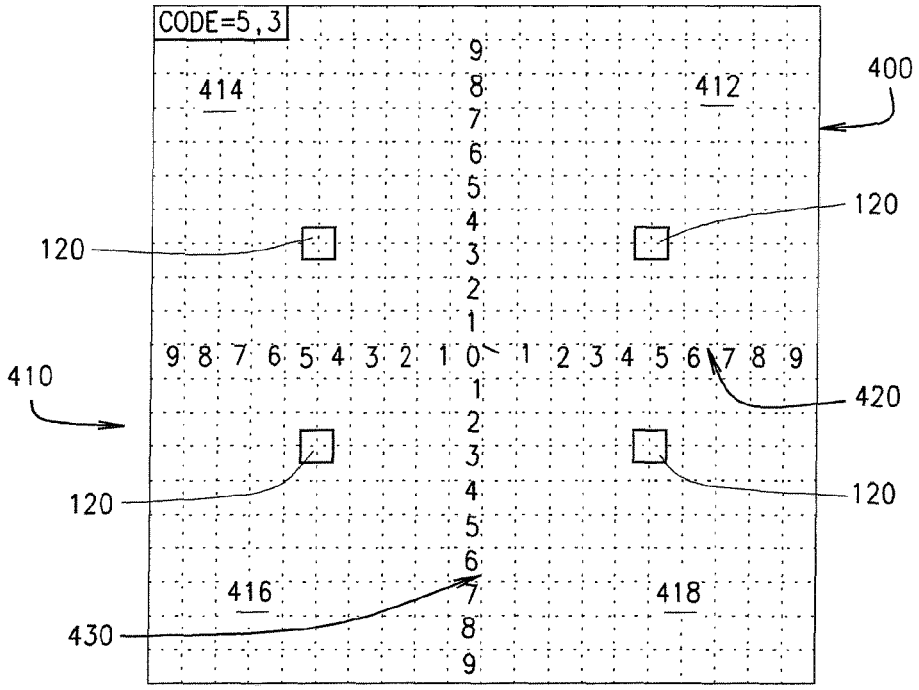
FIG. 3 is an exemplary table of the x-axis and y-axis positions of micro-dots as corresponding to each rank and suit of playing cards.
FIG. 4 is a graphical representation of micro-dots on the x-y axes referenced in FIG. 3.

FIG. 4 illustrates the actual 8×7 grid with a micro-dot placed at x-y coordinate (5, 3). As can be seen, the 8×7 grid has been replicated four times to create a full Cartesian coordinate x-y axis. Quadrants one (412), two (414), three (416) and four (418) each represent an individual 8×7 grid. Preferably, a micro-dot 120 is printed in each quadrant at its absolute value. Thus, the negative portions of the x- and y-axes are treated as the absolute values thereof such that the (5, 3) coordinate for the Five of Hearts is plotted at (5, 3), (−5, 3), (5, −3) and (−5, −3) in the Cartesian plane, the absolute value of each of which is equal to the (5, 3) coordinate.

By printing a micro-dot 120 in each quadrant, a frame of reference is created. The distance between any detected micro-dot 120 and the micro-dot 120 in an adjacent quadrant can be utilized to determine one of the x-y coordinates. For example, in FIG. 4, the micro-dot 120 in quadrant one (412) is ten spaces away from micro-dot 120 in quadrant two (414). As it is known that the micro-dots 120 in adjacent quadrants are equidistant from one another, it can be determined that each micro-dot 120 is five spaces away from the y-axis 430, and therefore that the x-coordinate is five. Similarly, the micro-dot 120 in quadrant two (414) is six spaces away from micro-dot 120 in quadrant three (416). Therefore, it can be determined that each micro-dot 120 is three spaces away from the x-axis 420, and therefore that the y-coordinate is three.

As can be seen, only the micro-dot 120 in a single quadrant, along with the micro-dots in the two immediately adjacent quadrants are needed to determine the x-y coordinates. In the above example, quadrant four (418) was unused. However, adding the micro-dot 120 in the fourth quadrant adds a level of redundancy. Alternatively, a different frame of reference may be used so as to necessitate only a single micro-dot 120, such as actual x-y axes. However, it has been found that three or four micro-dots 120 are the most inconspicuous way to create a frame of reference.

Figure 5:
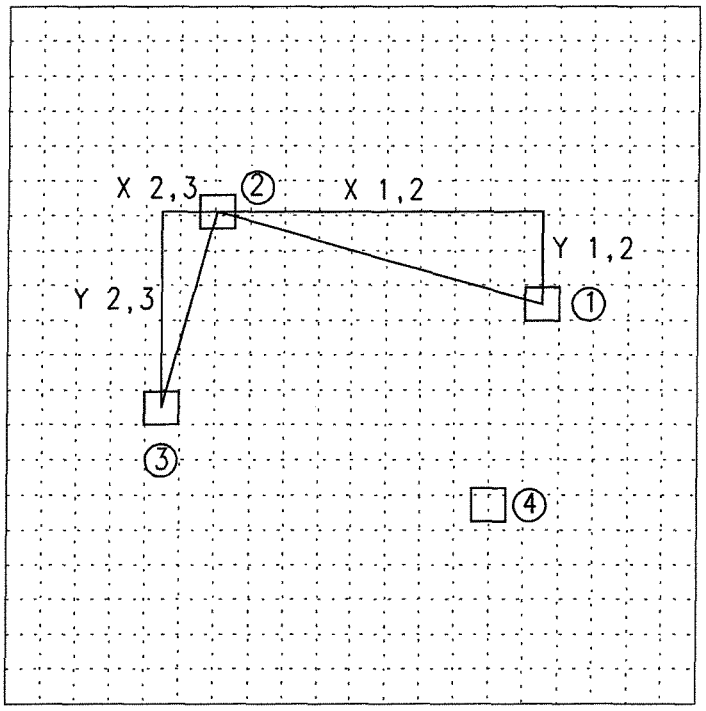
FIG. 5 is a graphical representation of tilted micro-dots and measurements therebetween.

However, when imaged, the micro-dots 120 may appear tilted, such as in FIG. 5. Therefore, in order to accurately determine the x-y coordinates in such a way as to take into account possible tilting of the micro-dots 120, the following formulas are used:

$$\text{Factor} = 1.0 - \frac{(Y_{12}/X_{12})^2}{2} = 1.0 - \frac{(52/193)^2}{2} = 0.964$$

$$HorizontalGridLocation = \text{Round}\left(\frac{\frac{X_{12}}{\text{Factor}}}{2*(DotSize)}\right) = \text{Round}\left(\frac{\frac{196}{0.964}}{2*20}\right) = \text{Round}(5.0052) = 5$$

$$VerticalGridLocation = \text{Round}\left(\frac{\frac{Y_{23}}{\text{Factor}}}{2*(DotSize)}\right) = \text{Round}\left(\frac{\frac{116}{0.964}}{2*20}\right) = \text{Round}(3.008) = 3$$

In these exemplary formulas, the size of the micro-dots 120 was preset at twenty pixels, while $X_{12}$, $Y_{12}$, and $Y_{23}$ were calculated from the exemplary image in FIG. 5 to be 193 pixels, 52 pixels, and 116 pixels, respectively. As can be seen, these formulas take into account the micro-dot 120 size as an additional frame of reference used to determine the size of a "unit of measure" between the grid locations. In this case, a micro-dot size of twenty pixels resulted in a horizontal grid location which is 5 "units of measure" from the y-axis. Larger or smaller micro-dot 120 sizes would alter the result, and therefore must be taken into account.

In the above a Cartesian coordinate system is described. However, it is envisioned that other coordinate systems can be used, include, but not limited to, polar, cylindrical, or spherical coordinate systems.

The Shoe and Game Controller Unit

Figure 6:
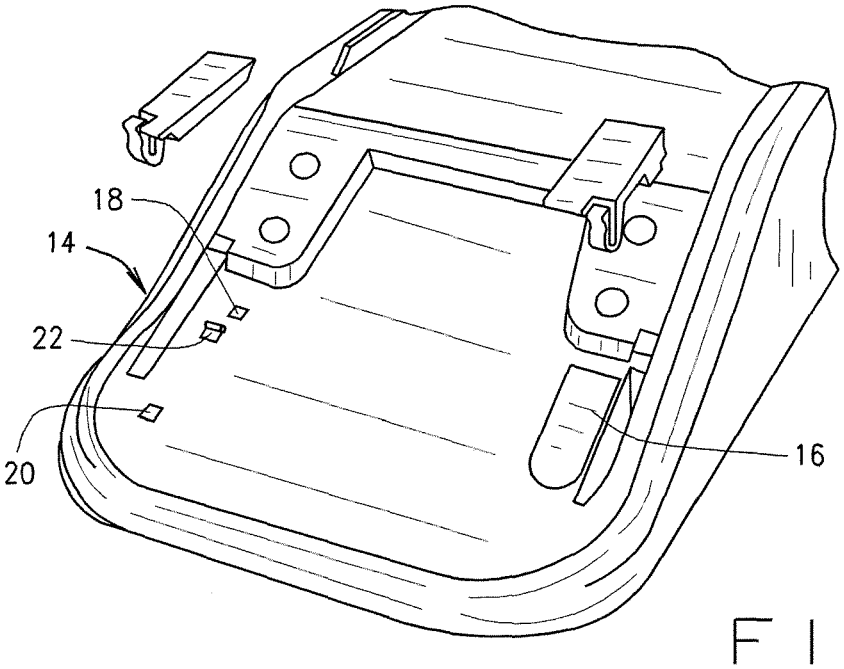
FIG. 6 is a perspective view of the shoe of FIG. 1 focused on the card guide section thereof.
Figure 7:
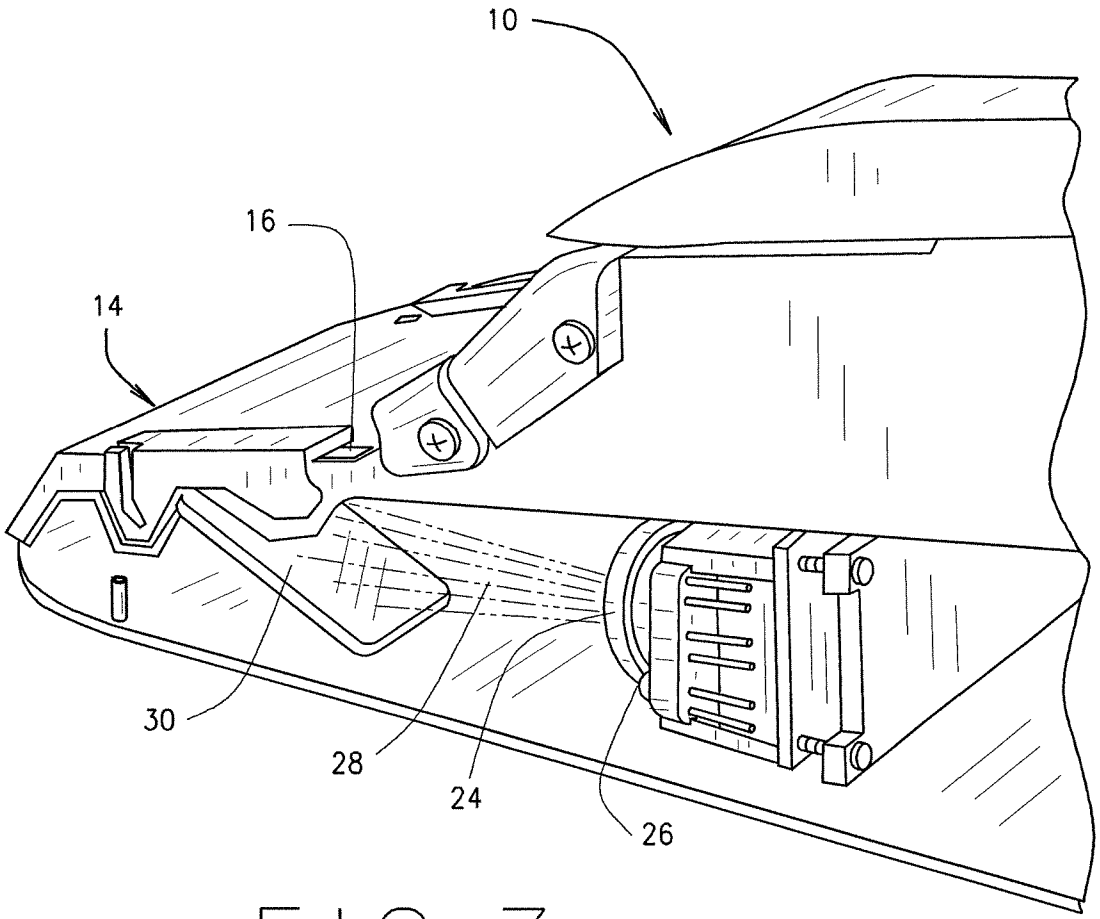
FIG. 7 is a partial side perspective view of the shoe's card guide section of FIG. 6 in which the side of the shoe has been removed to allow the internal components to be seen.

FIGS. 6 and 7 illustrate the card removal portion 14 of the shoe 10. Generally, a cover will be secured to the top of the card removal portion 14 to hide the inner-workings visible in FIG. 6. As shown in FIG. 7, the shoe 10 includes an image sensor 24 which detects images in its field of view 28. In one embodiment, 640×480 pixel CMOS camera is provided as the image sensor 24. Lights 26, which could be LEDs, strobe lights or any other type of light 26, are provided to add additional lighting. When yellow micro-dots 120 are used, it is preferable that a blue light source 26 or a white light source 26 with a blue filter be used to increase the contrast for the yellow micro-dots 120 from the rest of the image. When other colors of micro-dots are used, different light source colors may also be used to provide extra contrast. Alternatively, specific light colors may be unneeded for some colors of micro-dots.

In one embodiment, the light source 26 is constantly illuminated when the shoe is powered on. However, in other implementations, such as that shown in FIG. 6, at least a first card sensor 18, and preferably also a second card sensor 20, may act as strobe triggers when they detect the presence of a playing card 100 so as to cause the light source 26 to illuminate only when necessary.

FIG. 6 also illustrates a card gate 22, which can be actuated between a closed (raised) and open (lowered) position. This actuation is preferably accomplished via an electromagnet which helps to open the game when engaged. The card gate 22 is preferably spring-loaded to remain in a closed position until the electromagnet is engaged and the card gate 22 is actuated.

In a preferred embodiment, the imaging system may utilize at least one mirror 30 to provide a periscoping effect in capturing the image. As shown in FIG. 7, the field of view 28 of image sensor 24 may not be aligned so as to be able to capture an image through image window 16, based on the physical dimensions of the shoe 10. A mirror 30 may therefore be used to redirect the field of view 28 up through the image window 16 so as to properly image the regions of interest 110 on the face of a card 100. However, designs without mirrors 30 are also feasible. Where such mirrors 30 are used, (1) the angle of the mirror, (2) the optical path and (3) its apparent distortion of the micro-dot image should be considered when calculating the locations of and distances between the dots.

With an image device 24 having an image resolution of 640×480 pixels, an area of approximately 21×16 mm will be scanned. Typically 9 pixels (3×3) are sufficient to locate each micro-dot 120 precisely. A series of decision criteria and/or filtering algorithms are used to isolate the micro-dots in the image. This filtering algorithm also helps to remove spurious objects in the image or region of interest. In playing cards these spurious objects could be due to any or all of "scumming" (the splattering of ink during printing), card dust, or embedded fibers from the paper pulp.

The micro-dots 120 are preferably located in the scan using a binary large object detection ("BLOB") analysis. BLOB analysis generally attempts to detect points in an image that are darker than the surrounding. The factors used to isolate or identify the dots include: (1) a histogram of the pixel intensities in the image (used to remove the background); (2) the number of pixels in each object; (3) an aspect ratio of the objects between about 0.8 and 1.0, i.e., generally radially uniform (aspect ratio=pixels in y dimension/pixels in x dimension); and (4) the location of binary objects within region of interest (with reference to expectations based on card registration and manufacturing tolerances). Generally, the largest four objects are selected, though it is recognized that where even smaller micro-dots 120 are used, the dots may be smaller than surrounding imperfections. Additionally or in the alternative, the use of a colored light source 26 to contrast the color used for the micro-dots 120 may be used as described above to assist in locating the micro-dots.

Figure 8A:
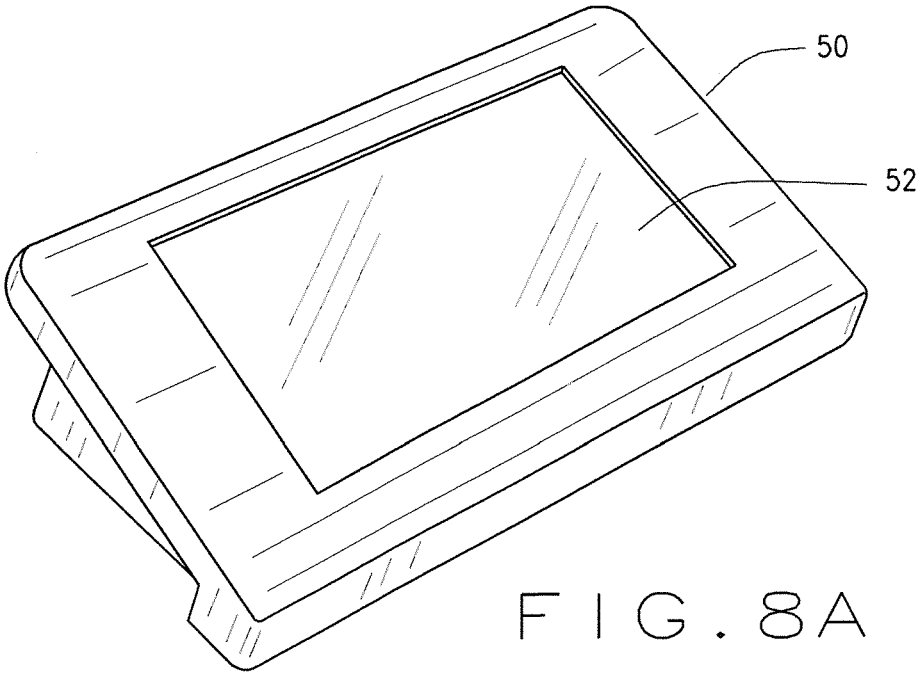
FIGS. 8A and 8B are front and rear perspective views respectively of the game controller unit of FIG. 1.
Figure 8B:
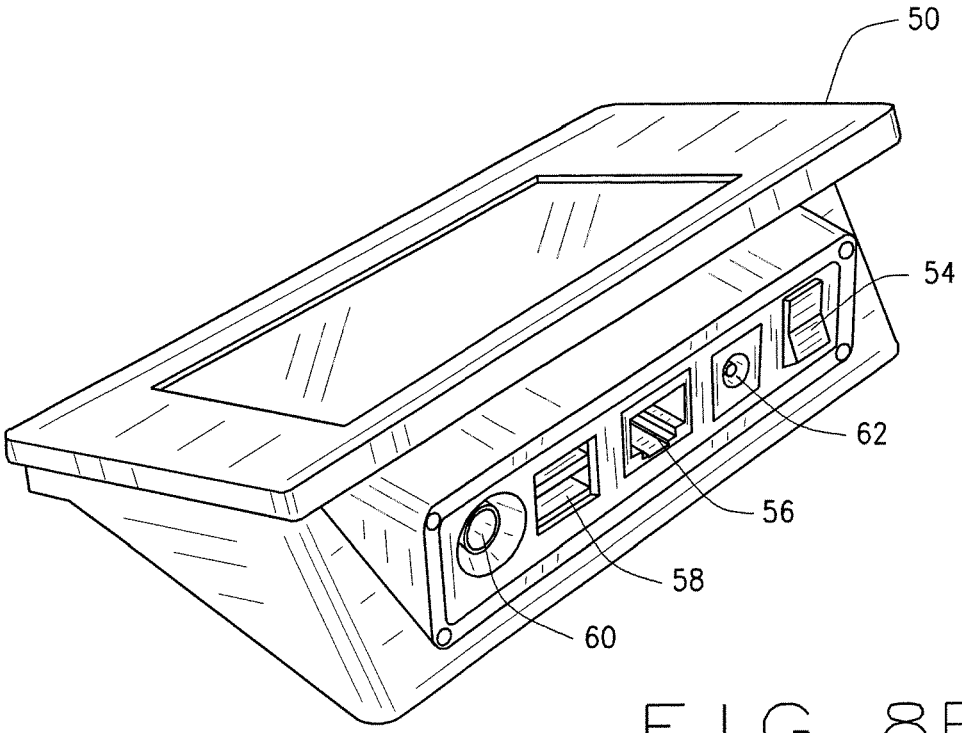

As noted above, the shoe 10 is connected to a game controller unit 50. FIGS. 8A and 8B illustrate the front and rear of an exemplary game controller unit 50. In FIG. 8A, a display screen 52 on the front of the game controller unit 50 is visible. Internally, a processor is provided for processing data received from the shoe (not shown), as well as an electronic memory for storing data (not shown).

In one embodiment of the game controller unit 50 described herein, display screen 52 is a 5"×3" touch screen 52 (which can be a resistive touch screen or a capacitive touch screen) which provides a large area for viewing the GUI menu and the game outcomes. The GUI display 52 is also preferably in color and can be customized for the casino and personalized for the user. The screen 52 may be tilted at a slight twenty degree angle to the horizontal to allow for convenient viewing by the dealer, and to provide sufficient visibility to the eye-in-sky (surveillance) cameras at the casino. The graphical user interface (GUI) may also be configured or programmed such that the user can interact with the device in a language that is familiar to them. Programming to allow the system to display in any desired language may be provided.

As can be seen in FIG. 8B, the game controller unit 50 also includes various input/output ports, including USB ports 58, a DC-IN port 62 for power, a table lights port 60, and an Ethernet port 56. A power switch 54 is also shown. Power may be supplied to the game controller unit 50 through the DC-IN port 62, via the Ethernet port 56, or by any other suitable means. It is noted that USB ports may be used to connect the game controller unit 50 to the shoe 10, to an additional game display, or to other electronics as needed. Further, necessary updates and upgrades to the firmware or software of the game controller unit 50 may be accomplished through, for example, the use of a USB stick. The manufacturer of the equipment ships a jump-drive (USB stick) to the casino with the necessary upgrades. The casino or equipment administrator plugs the USB stick into the USB port 58 on the back of the game controller. Upon user authentication for security purposes, the necessary upgrades are automatically loaded into the equipment. This provides efficiencies in servicing the equipment with no or minimal down times and reduced labor costs to both the manufacturer and the customer. Other portable storage mediums, such as memory sticks, may alternatively be used.

The dealing of cards in playing games at casino tables is mostly manual and therefore susceptible to errors. The current invention includes the above mentioned mechanical card gate 22 to minimize or eliminate some of these possible errors. The game controller unit 50 controls the functionality of the card gate 22 based on the game progress and the identification of the card values that are drawn from the shoe 10. Chiefly, the card gate 22 prevents cards from being inadvertently pulled out of the shoe 10 even after the game outcome is decided. Card overdraw, as this is called, is a common mistake at game tables and can unnecessarily disrupt the progress of the game at the table. The game controller unit 50 also reminds the dealer to collect commissions when the game played at the table is Commission Baccarat. Both of these features will be discussed in detail below, in connection with FIG. 11.

The card gate 22 is spring loaded in the closed position. This is the default position. When it is to be moved to the open position, the game controller unit 50 sends a trigger to an electro-magnet. The electro-magnet then pulls the card gate 22 down into the open position allowing cards 100 to be pulled out of the shoe 10. The card gate 22 is a small metallic piece that is located on either side of the nose 14 of the shoe 10 and is positioned so as to be covered by the face plate. Damping devices can be used to prevent any sounds during the operation of the card gate 22 so that it does not disrupt or provide unnecessary advantage to the players at the game table.

In the above, the controller 50 is disclosed as being connected to the shoe 10 via a cable 40. However, it is contemplated that the controller 50 can be integrated into the shoe 10 itself or removable attachable to the shoe 50 itself. It is also contemplated that the controller 50 can be wirelessly connected to the shoe.

The System in Operation

Figure 9:
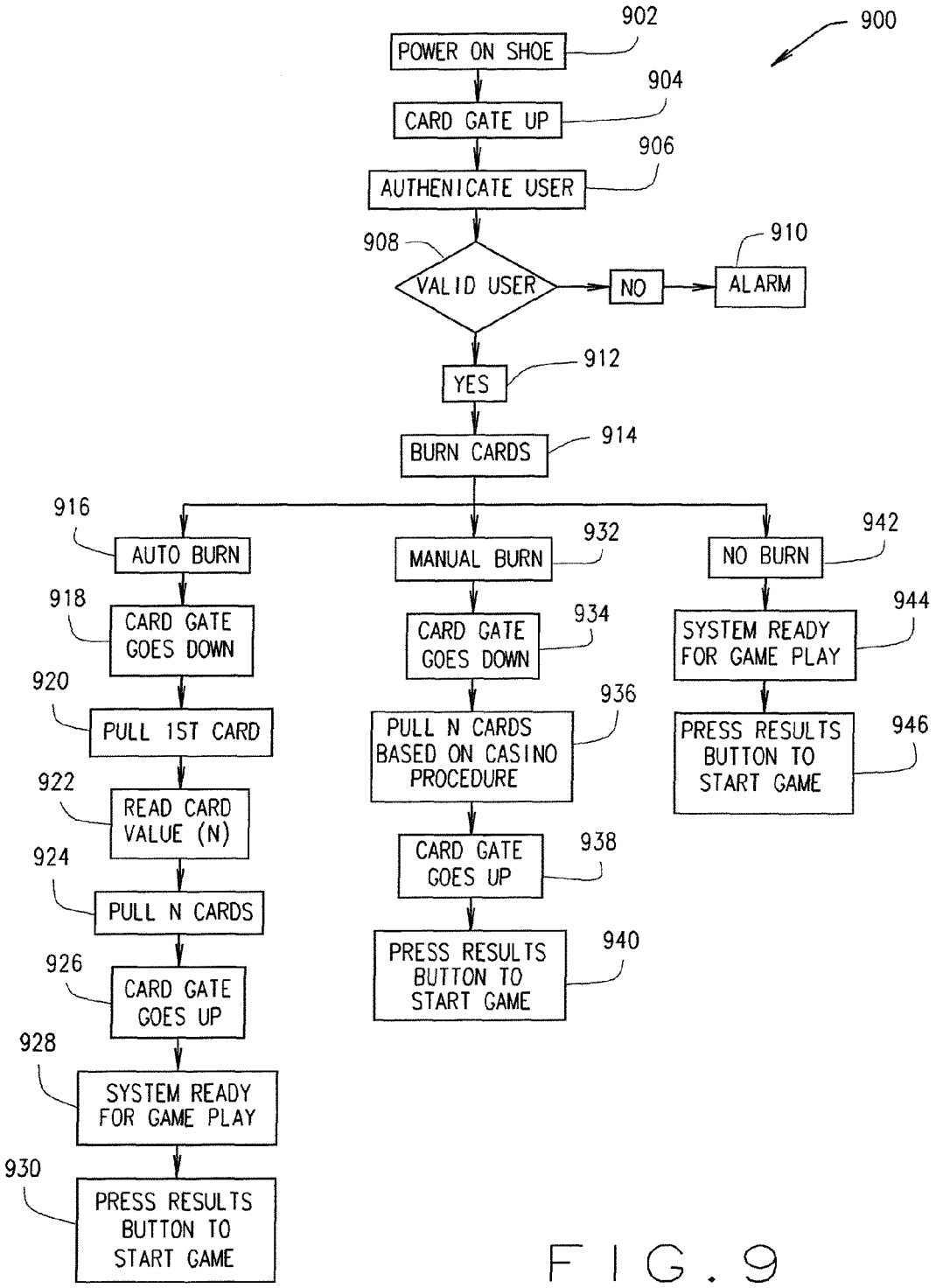
FIG. 9 is a flow chart of the present shoe's power-on and card burn procedures.

FIG. 9 is a flow chart of exemplary card burn processes 900, which illustrates one usage of the card gate 22. At step 902, the shoe is powered on, and at step 904 the card gate is up to prevent cards from being drawn. At step 906, the user—either a pit boss or dealer—authenticates his/her authority to use the shoe, either through a username and password, thumb print, or other unique identifier. At step 908, an authentication check is made, and if the check fails, an alarm is activated at step 910. Presuming the authentication is successful, the game controller unit proceeds to step 914 in which cards are "burned" or discarded prior to a game. Generally, three options exist for card burning procedures—an auto-burn (step 916), a manual burn (step 932) or no burn (step 942). In an auto-burn (step 916), the card gate is actuated and lowered to allow cards to be drawn at step 918, and at step 920, the first card is pulled. The shoe reads the rank of the card ("N") at step 922 via the micro-dots present thereon, and the game controller unit then causes the card gate to remain open while N cards are drawn and "burned" at step 924. Once N number of cards have been drawn, the game controller unit causes the card gate to close at step 926 so that no more cards can be drawn. At step 928, the system is then ready for play, and at step 930, a button is pressed to commence the game.

Alternatively, with a manual burn (step 932), the game controller unit actuates the card gate to lower it at step 934, at which point a predetermined number of cards are drawn and "burned" at step 936, based on casino procedure. Once the game controller unit determines that the predetermined number of cards have been burned, the card gate closes at step 938 to prevent further cards from being drawn. At step 940, the system is ready for play and a button is pressed to start the game. Where no cards are burned (step 942), the system is immediately ready for play at step 944, and a button is pressed at step 946 to commence the game.

Figure 10A:
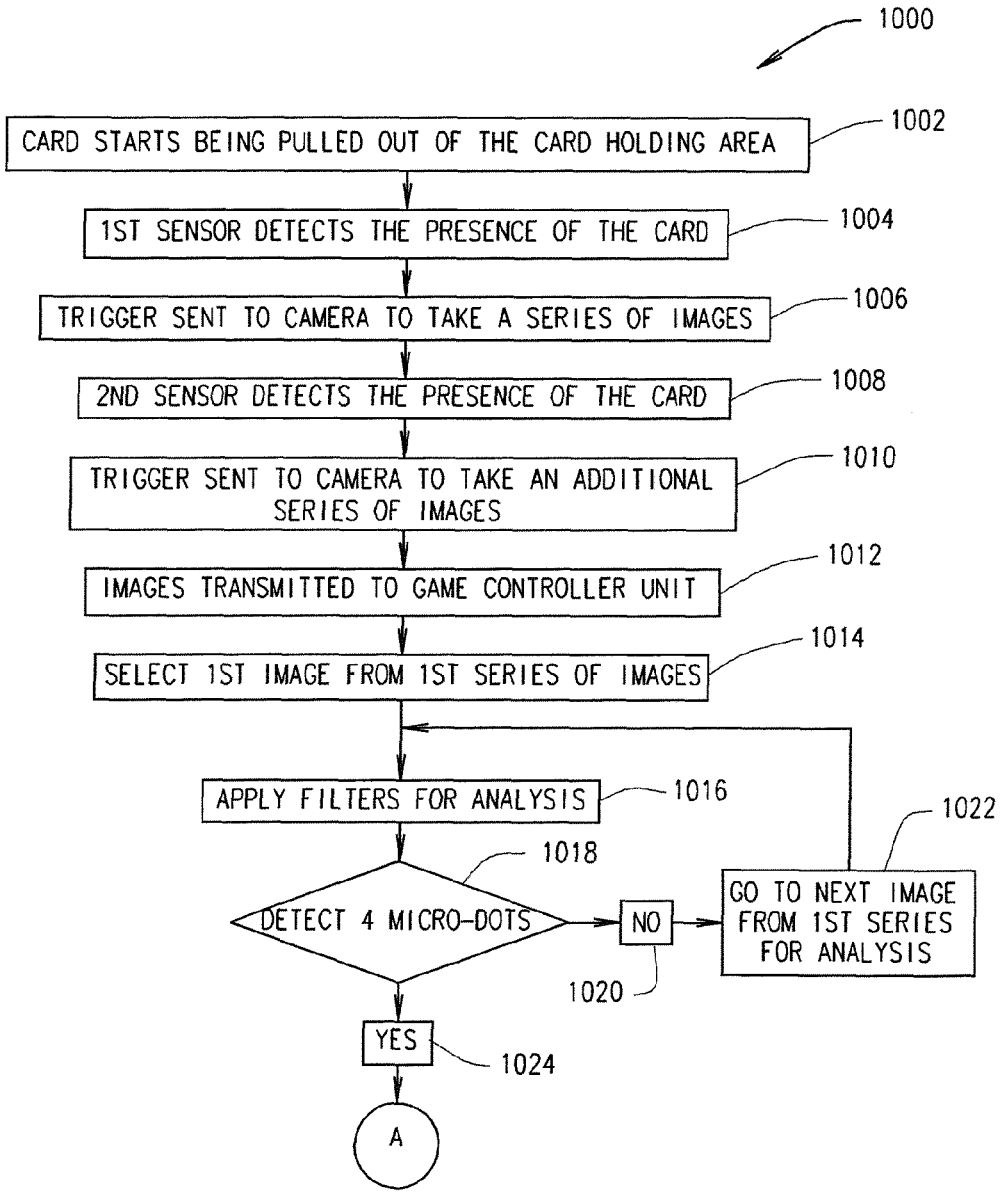
FIGS. 10A and 10B are flow charts of the process by which the micro-dots on a playing card are read as the card is withdrawn from the present shoe.
Figure 10B:
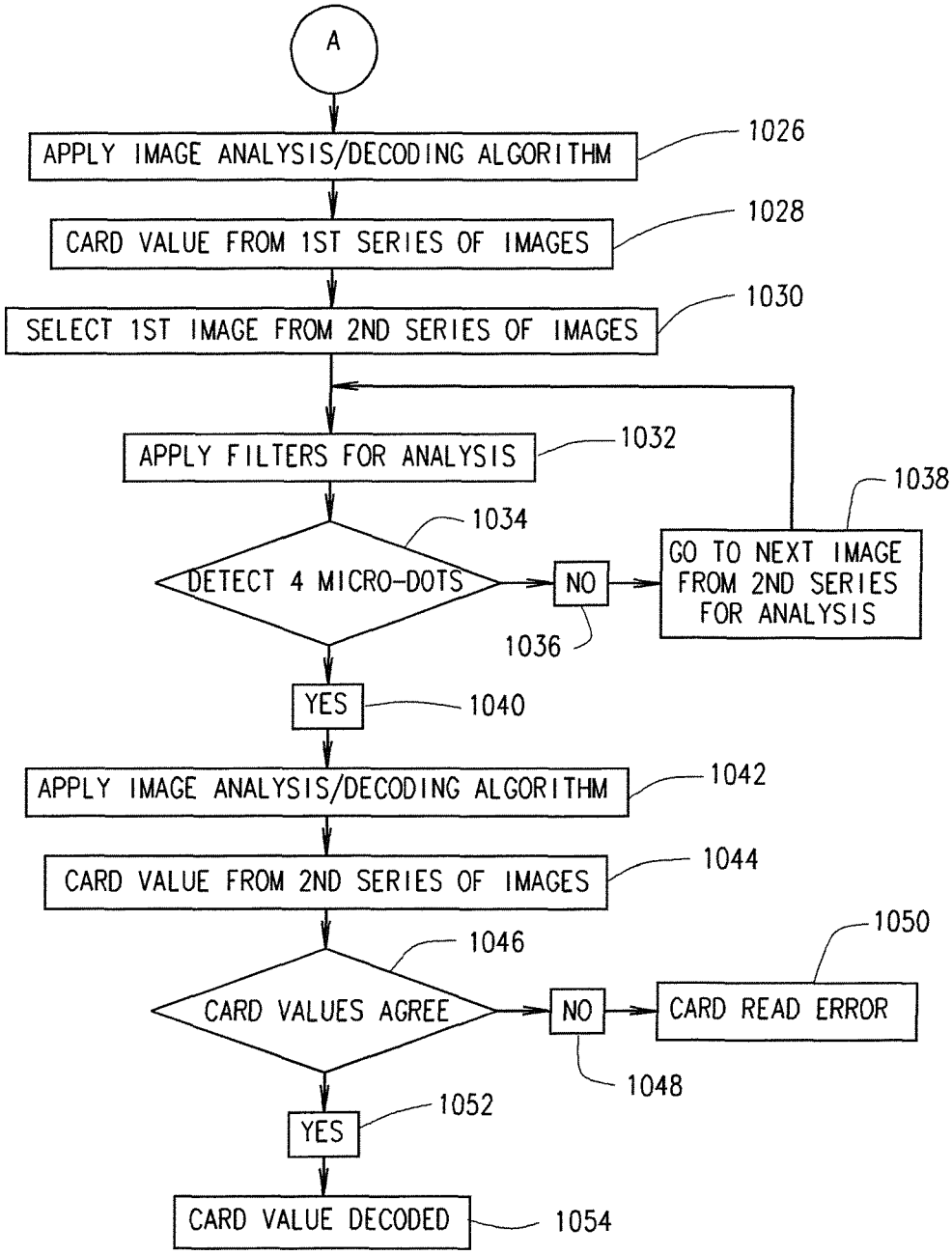

As will be understood, card gate 22 plays an important role in ensuring the proper drawing of cards 100. However, an even more important task is the proper detection of micro-dots 120 and the proper determination of the rank and suit of the card drawn. As noted above, the micro-dot pattern may be printed in more than one region of interest 110, and each region of interest 110 may be imaged for redundancy. To effectuate such redundancy (as discussed in connection with FIG. 6), shoe 10 may be provided with both a first card sensor 18 and a second card sensor 20, each of which is individually capable of triggering the imaging of a card 100, and causing the light source 26 to illuminate if desired. FIG. 10 illustrates a flow chart of an exemplary process 1000 for redundant imaging of a region of interest 110.

At step 1002, a card is drawn. At step 1004, the first card sensor senses the card as it is drawn out of the shoe, and triggers the imaging device to take a series of images at step 1006. At step 1008, the second card sensor senses the card as it is drawn further out of the shoe, and triggers the imaging device to take another series of images at step 1010. At step 1012, the images are transferred to the game controller unit.

At step 1014, the game controller unit selects the first image from the first series of images, and applies the applicable filters for locating the micro-dots at step 1016. At step 1018, a determination is made as to whether four micro-dots have been detected. Where four micro-dots have not been detected at step 1020, the game controller unit discards the image and selects the next image from the first series of images at step 1022, returning to step 1016 with the next image for the application of filters. This process repeats until four micro-dots are detected at step 1024. Once four micro-dots are detected, image analysis and decoding algorithms are applied at step 1026, and the card rank and suit are determined at step 1028.

Next, at step 1030, the game controller unit selects the first image from the second series of images, and applies the applicable filters for locating the micro-dots at step 1032. At step 1034, a determination is made as to whether four micro-dots have been detected. Where four micro-dots have not been detected at step 1036, the game controller unit discards the image and selects the next image from the second series of images at step 1038, returning to step 1032 with the next image for the application of filters. This process repeats until four micro-dots are detected at step 1040. Once four micro-dots are detected, image analysis and decoding algorithms are applied at step 1042, and the card rank and suit are determined at step 1044.

At step 1046, a determination is made as to whether the card rank and suit information determined from the first group of images agrees with the information determined from the second group of images. Where the information from the two sets of images does not agree at step 1048, a card read error is returned at step 1050. However, where the information does agree at step 1052, the game controller unit determines that the card value has been accurately decoded at step 1054.

Figure 12A:
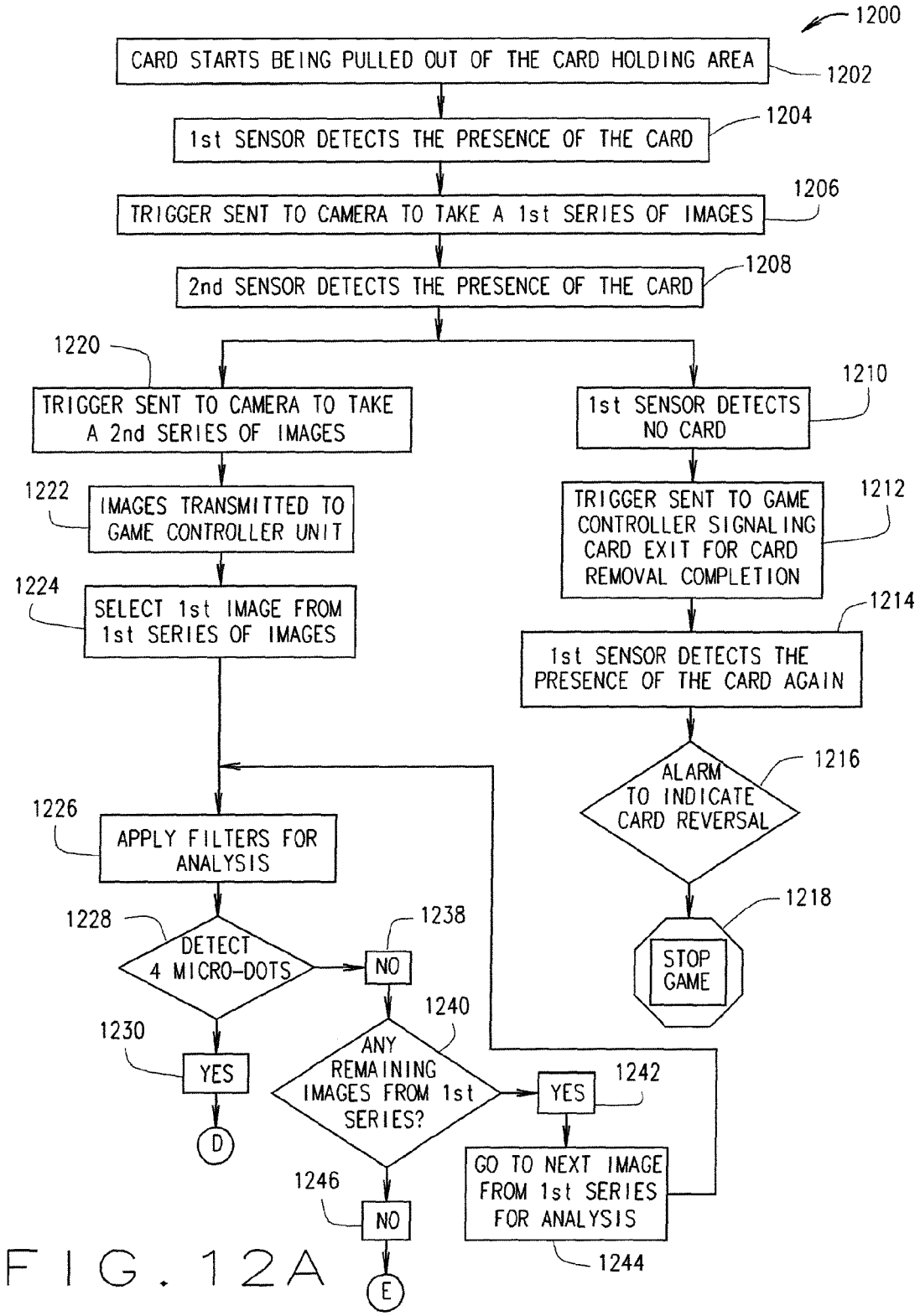
FIGS. 12A and 12B are flow charts of an alternative card-reading process as the card is withdrawn from the present shoe.
Figure 12B:
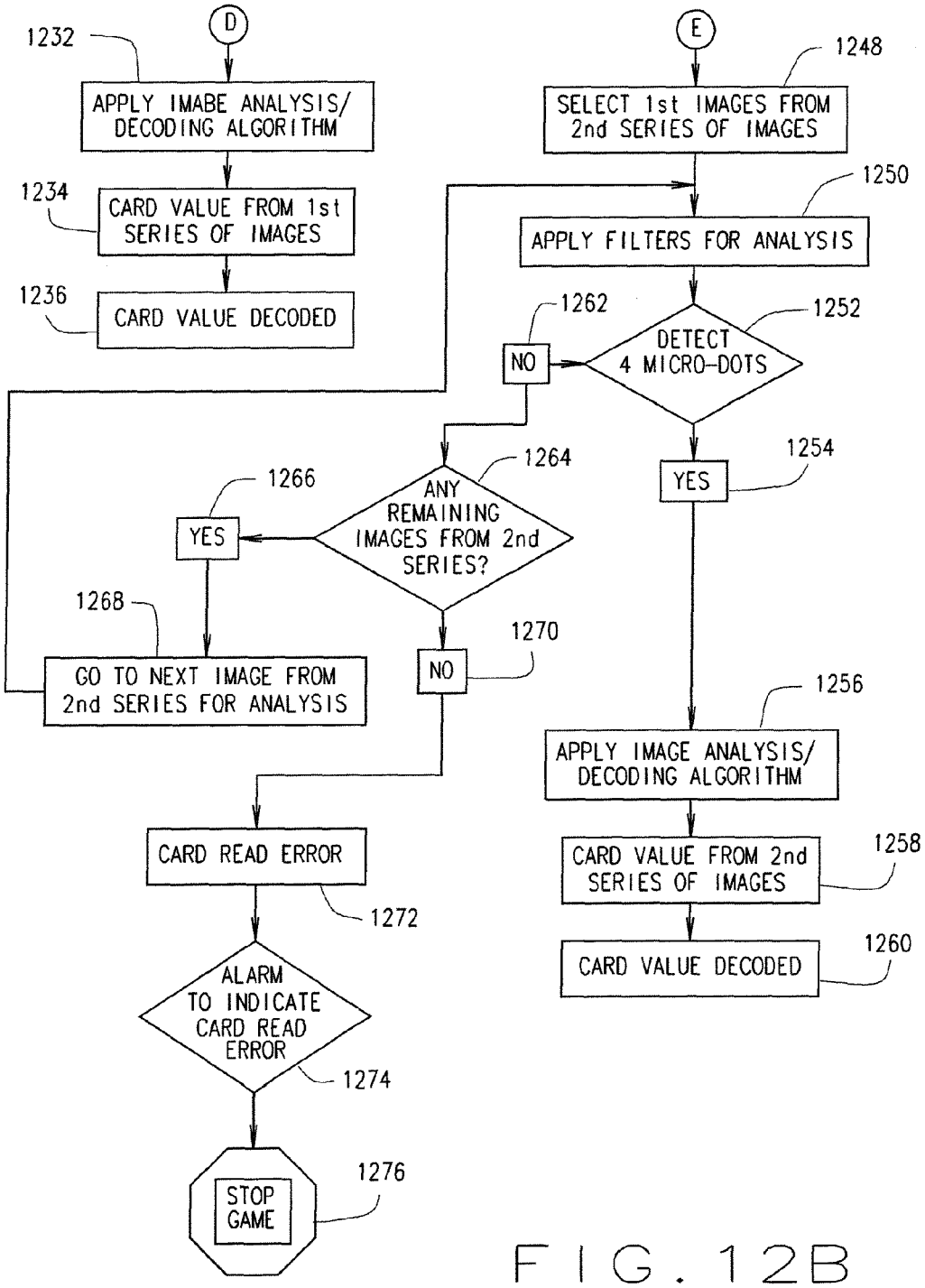

FIGS. 12A and 12B include flow charts which illustrate an alternative embodiment of the present invention, in which the imaging of regions of interest 110 is not necessarily redundant, and in which card reversal is monitored. The process in FIG. 12A begins similarly to that discussed above in connection with FIG. 10A. At step 1202, a card starts being pulled out of the shoe. At step 1204, the first card sensor detects the presence of the card, and triggers the image sensor to take a first series of images at step 1206. At step 1208, the second card sensor detects the presence of the card.

At this point, two processes occur simultaneously. In the first, the shoe is monitored for card reversal. This monitoring process preferably occurs continuously while a card is being drawn from the shoe. In practice, when the first card sensor no longer detects the card at step 1210, at step 1212 a signal is sent to the game controller unit to indicate that the card removal has continued (i.e., that the card has been pulled out of the shoe to the point that it has passed completely by the first card sensor). However, if the first sensor thereafter again detects the presence of the card at step 1214 while the second sensor still indicates that the card is present (i.e., that the card was never fully pulled from the shoe and is being returned into the shoe), an alarm is triggered to indicate card reversal at step 1216. Such a situation would occur when a dealer begins to pull the card out of the shoe, and then attempts to return it back into the shoe improperly. As this may suggest cheating (i.e., that the dealer is trying to show the value of the card to an accomplice playing at the table before actually drawing the card for play), the game is then stopped at step 1218.

A card reversal error may also occur where the first and second card sensors cease to indicate that a card is present (suggesting that the card has been fully removed from the shoe), after which the second card sensor begins to detect the presence of a card before the first card sensor detects the presence of a card. Such a series would suggest that the withdrawn card is being placed back into the shoe, which would similarly create a card reversal issue. Conversely, once the first and second card sensors cease to indicate that a card is present, the first card sensor may thereafter detect the presence of a card without a problem. This would merely suggest that a new card is being withdrawn from the shoe. Thus, the second card sensor can indicate a full card exit and completion of the card removal process.

Simultaneously with the card reversal monitoring process described above, at step 1220 the imaging sensor takes a second series of images due to the second card sensor's detection of the presence of a card at step 1208. The images are transmitted to the game controller unit at step 1222. At step 1224, the first image from the first series of images is selected, and at step 1226 filters are applied in order to analyze the image. At step 1228, a check is made to determine whether four micro-dots have been detected in the image. If four micro-dots have been detected at step 1230, image analysis techniques and decoding algorithms are applied to the image at step 1232 (see FIG. 12B). The card rank and suit information can thereby be determined from the first series of images at steps 1234 and 1236, without the need to refer to the second series of images.

Where four micro-dots are not detected at step 1238 (see FIG. 12A), a check is performed to determine if there are any remaining images from the first series which have yet to be analyzed at step 1240. Where there is at least one additional image from the first series at step 1242, the game controller unit moves on to the next image at step 1244 and the process returns to step 1226 to apply filters for analysis of the next image.

However, where there are no remaining images from the first series of images at step 1246, the process moves on to the first image in the second series of images at step 1248 (see FIG. 12B). At step 1250, filters are applied to the image, and at step 1252 a check is made to determine whether four micro-dots have been detected. If four micro-dots have been detected at step 1254, image analysis techniques and decoding algorithms are applied to the image at step 1256. The card rank and suit information can thereby be determined from the second series of images at steps 1258 and 1260, regardless of the lack of a successful micro-dot reading from the first series of images.

Where four micro-dots are not detected at step 1262, a check is performed to determine if there are any remaining images from the second series which have yet to be analyzed at step 1264. Where there is at least one additional image from the second series at step 1266, the game controller unit moves on to the next image at step 1268 and the process returns to step 1250 to apply filters for analysis of the next image.

However, where there are no remaining images from the second series of images at step 1270, a card read error has occurred at step 1272. Indeed, in the embodiment as shown in FIGS. 12A and 12B, the second series of images is only analyzed if a set of micro-dots could not be located in any of the first series of images. Therefore, when, at step 1270, there are no further images to analyze in the second series of images, there are no further images to be analyzed at all. An alarm is therefore triggered at step 1274 due to a card read error, and the game is stopped at step 1276. However, it is noted that any number of image series may be taken, in which case the method shown in FIGS. 12A and 12B could progress on to the analysis of those extra image series.

Figure 11A:
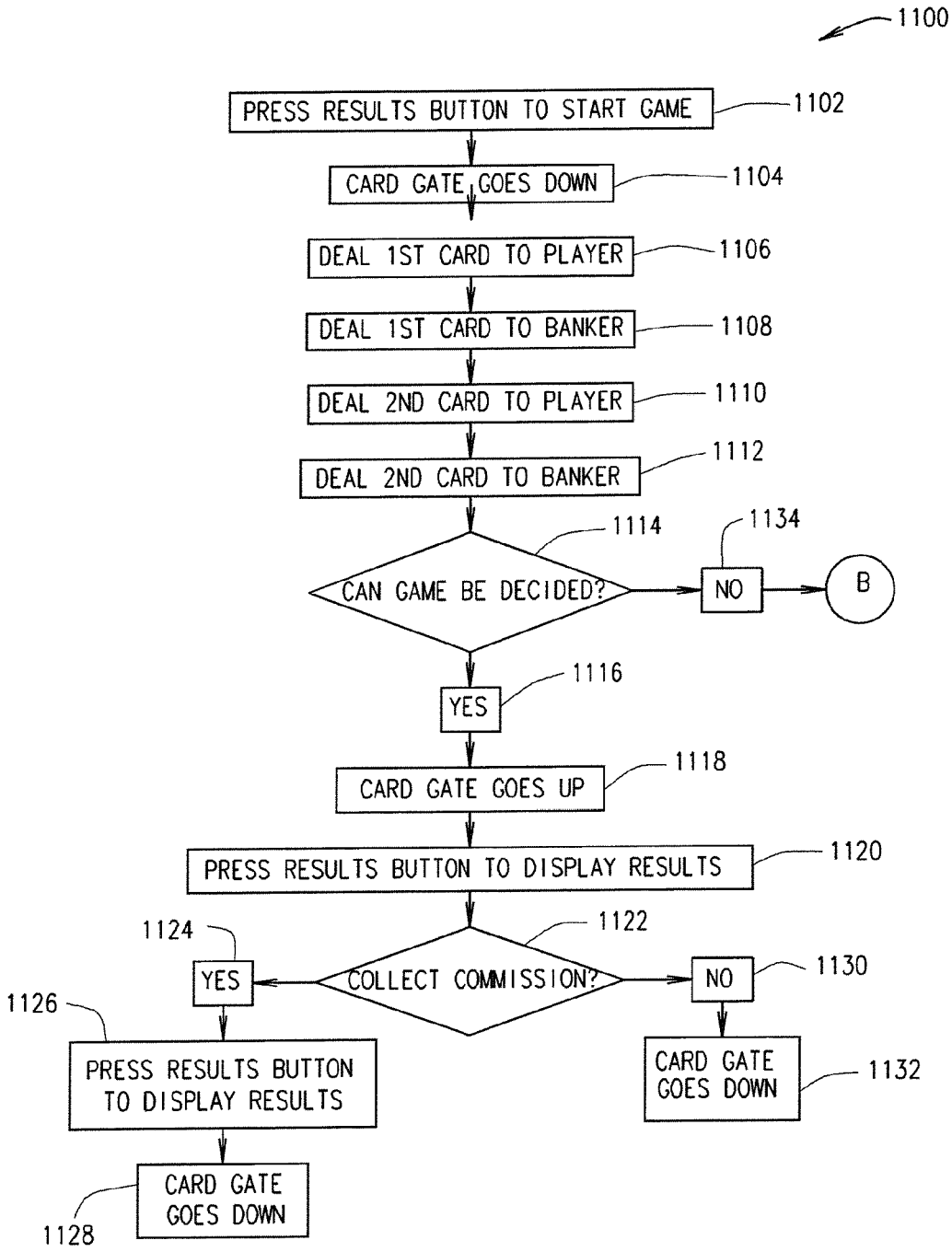
FIGS. 11A and 11B are flow charts of the process carried out by the present shoe and controller during an exemplary game of Baccarat.
Figure 11B:
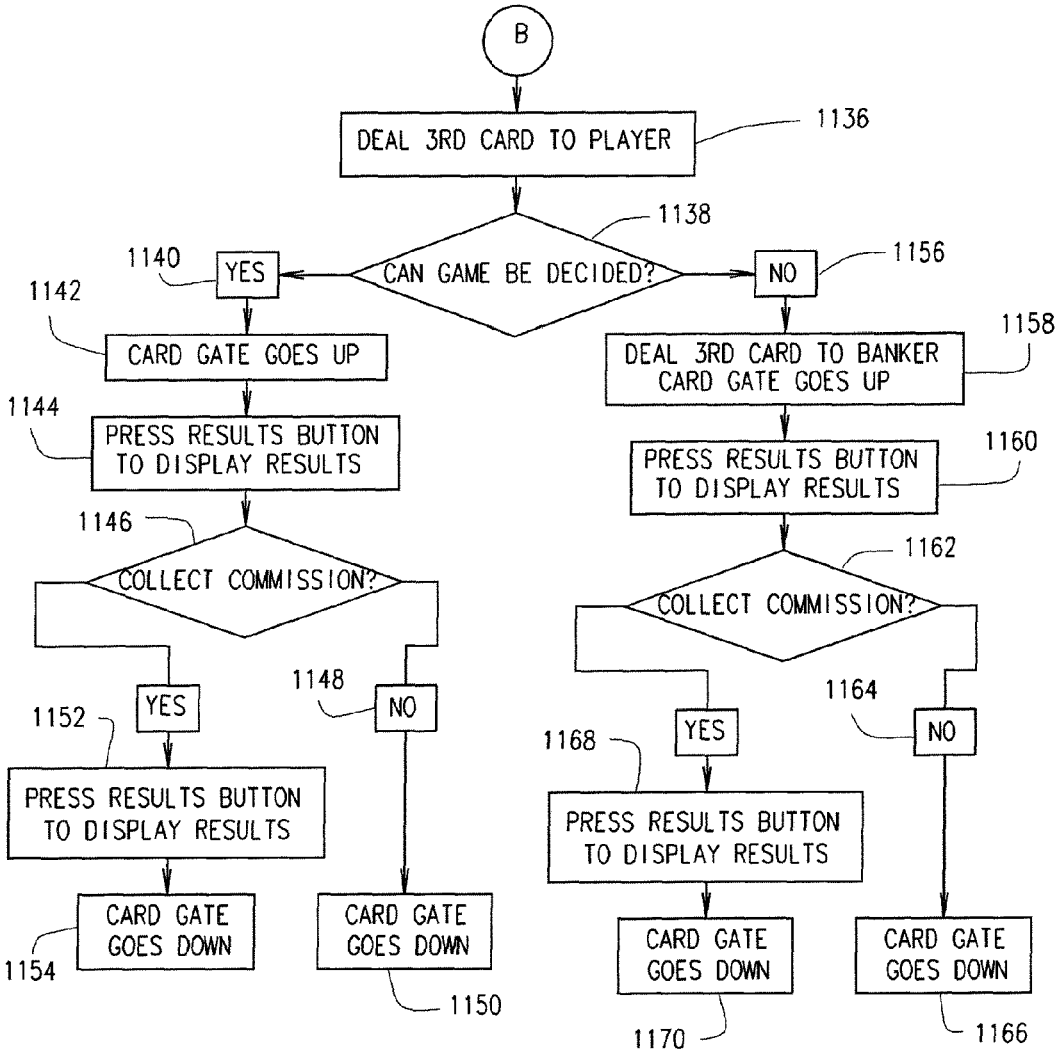

FIG. 11 contains a flow chart of an exemplary game of Baccarat 1100 to illustrate the workings of the entire intelligent table game system 1. At step 1102, a button is pressed to initiate the game, at which point the game controller unit actuates the card gate to open it for play at step 1104. At steps 1106, 1108, 1110, and 1112, the dealer deals the player a first card, the banker a first card, the player a second card, and the banker a second card, respectively. As each card is dealt, the shoe images at least one region of interest on each card, and the game controller unit determines the rank and suit of each such card. Based on the known ranks of the cards dealt, the game controller unit determines if the game can be decided at step 1114 according to the normal rules of Baccarat. If the game's outcome can be decided at step 1116, the game controller unit causes the card gate to close such that no more cards may be dealt at step 1118. This can serve as notice to the dealer that the game is over, even where the dealer mistakenly believes otherwise—when the dealer reaches for another card, the shoe prevents same from being dealt. Once the dealer presses a button to display the results at step 1120, the game controller unit determines whether a commission is to be collected at step 1122. If so, at step 1124, the commission is collected and the dealer presses a button to again display the results at step 1126. This also resets the game, preparing the shoe for another hand, and the game controller unit therefore opens the card gate at step 1128. Where no commission is to be collected at step 1130, the game controller unit similarly opens the card gate at step 1132 to prepare for another hand.

If, at step 1114, the game cannot yet be decided (step 1134), a third card is dealt to the player and the rank is determined by the game controller unit. Based on the known ranks of the cards dealt, the game controller unit again determines if the game can be decided at step 1138 according to the normal rules of Baccarat. If the game's outcome can be decided at step 1140, the game controller unit causes the card gate to close such that no more cards may be dealt at step 1142. This can again serve as notice to the dealer that the game is over, even where the dealer mistakenly believes otherwise. Once the dealer presses a button to display the results at step 1144, the game controller unit determines whether a commission is to be collected at step 1146. If so, the commission is collected and the dealer presses a button to again display the results at step 1152. This also resets the game, preparing the shoe for another hand, and the game controller unit therefore opens the card gate at step 1154. Where no commission is to be collected at step 1148, the game controller unit similarly opens the card gate at step 1150 to prepare for another hand.

If, at step 1138, the game cannot yet be decided (step 1156), a third card is dealt to the banker at step 1158, and the rank is determined by the game controller unit. Based on the known ranks of the cards dealt, the game controller unit again determines the outcome of the game according to the normal rules of Baccarat. The game controller unit then causes the card gate to close such that no more cards may be dealt. This can again serve as notice to the dealer that the game is over, even where the dealer mistakenly believes otherwise. Once the dealer presses a button to display the results at step 1160, the game controller unit determines whether a commission is to be collected at step 1162. If so, the commission is collected and the dealer presses a button to again display the results at step 1168. This also resets the game, preparing the shoe for another hand, and the game controller unit therefore opens the card gate at step 1170. Where no commission is to be collected at step 1164, the game controller unit similarly opens the card gate at step 1166 to prepare for another hand.

It is believed that an intelligent table game system will be understood from the foregoing description, and it will be apparent that various changes may be made in the form, construction and arrangement of the elements without departing from the spirit or scope of the invention, and that the embodiments described above are merely exemplary in nature and not intended to define the limits of the invention or narrow the scope beyond that described above.

Many changes, modifications, variations and other uses and applications of the present constructions will, however, become apparent to those skilled in the art after considering this specification and the accompanying drawings. All such changes, modifications, variations and other uses and applications which do not depart from the spirit and scope of the invention are deemed to be covered by the invention which is limited only by the claims which follow. The scope of the disclosure is not intended to be limited to the embodiments shown herein, but is to be accorded the full scope consistent with the claims, wherein reference to an element in the singular is not intended to mean "one and only one" unless specifically so stated, but rather "one or more." All structural and functional equivalents to the elements of the various embodiments described throughout this disclosure that are known or later come to be known to those of ordinary skill in the art are expressly incorporated herein by reference and are intended to be encompassed by the claims which follow.

What is claimed is:

1. A shoe for holding playing cards, the shoe comprising:

a card cradle for holding playing cards;

a card removal portion for allowing the playing cards to be manually removed from said shoe;

a controller unit;

image sensor for detecting the presence and location of micro-dots on the face of a playing card in a plurality of regions as the playing card is drawn out of the card removal portion and past a field of view of the image sensor, the micro-dots are printed in visible ink in a pattern, said pattern encoding the rank and suit of the card, wherein said micro-dots are sized to not be visible to the unaided human eye, wherein the rank and suit of each playing card is each encoded via an x-y coordinate grid, in which at least one location on the grid represents the rank and suit of each playing card;

a card reversal monitor including at least a first and second card sensors positioned in the card removal portion, the second card sensor being positioned after the first card sensor, proximal to an exit in the card removal portion, wherein the first and second card sensors detect the presence of a playing card in the card removal portion, and the first and second card sensors are in data communication with the controller unit, and wherein the controller unit determines that a card reversal has occurred where the second card sensor continues to detect the playing card while the first card sensor detects the playing card after ceasing to detect the playing card.

2. A shoe for holding playing cards as set forth in claim 1, further including at least one light source for illuminating the face of the playing card as the playing card is imaged.

3. A shoe for holding playing cards as set forth in claim 2, wherein the light source produces a colored light against which the micro-dots are contrasted so as to render the micro-dots more easily detectable by the image sensor.

4. A shoe for holding playing cards as set forth in claim 2, wherein the card removal portion includes an image window through which the image sensor can image the micro-dots on a playing card as the playing card is drawn out of the card removal portion and across the image window.

5. A shoe for holding playing cards as set forth in claim 2, wherein the image sensor is one of an area scan CCD or CMOS camera.

6. A shoe for holding playing cards, the shoe comprising:

a card cradle for holding playing cards;

a card removal portion for allowing the playing cards to be manually removed from said shoe;

a card gate for selectively preventing a playing card from being drawn out of Me card removal portion;

a controller unit;

a card reversal monitor including at least a first and second card sensors positioned in the card removal portion, the second card sensor being positioned after the first card sensor, proximal to an exit in the card removal portion, wherein the first and second card sensors detect the presence of a playing card in the card removal portion, and the first and second card sensors are in data communication with the controller unit, and wherein the controller unit determines that a card reversal has occurred where the second card sensor continues to detect the playing card while the first card sensor detects the playing card after ceasing to detect the playing card.

7. A shoe for holding playing cards as set forth in claim 2 wherein:

the controller unit in data communication with the image sensor, the controller unit including:

a processor for receiving an image from the imaging sensor, determining the location of the micro-dots, and determining the rank and suit of the playing card therefrom; and a display screen for displaying information relating to a card game being played.

8. The shoe for holding playing cards as set forth in claim 6, further comprising an image sensor for detecting the presence and location of micro-dots on the face of a playing card in a plurality of regions as the playing card is drawn out of the card removal portion and past a field of view of the image sensor, said micro-dots are printed in visible ink in a pattern, said pattern encoding the rank and suit of the card, wherein the micro-dots are sized to not be visible to the unaided human eye, wherein the rank and suit of each playing card is each encoded via an x-y coordinate grid, in which at least one location on the grid represents the rank and suit of each playing card.

9. The shoe for holding playing cards as set forth in claim 8, wherein:

the controller unit in data communication with the image sensor, the controller unit including:

a processor for receiving an image from the imaging sensor, determining the location of the micro-dots, and determining the rank and suit of the playing card therefrom; and a display screen for displaying information relating to a card game being played.

* * * * *